US007273977B1

(12) United States Patent
Reitsam

(10) Patent No.: US 7,273,977 B1
(45) Date of Patent: Sep. 25, 2007

(54) TIMPANI WITH A FOLDABLE LEG ASSEMBLY

(75) Inventor: T. Reitsam, Nijehaske (NL)

(73) Assignee: K.H.S. Musical Instrument Co., Ltd, Lu Chou (TW)

( * ) Notice: Subject to any disclaimer, the term of this patent is extended or adjusted under 35 U.S.C. 154(b) by 0 days.

(21) Appl. No.: 11/406,650

(22) Filed: Apr. 19, 2006

(51) Int. Cl.
*G10D 13/04* (2006.01)

(52) U.S. Cl. ..... 84/419

(58) Field of Classification Search ..... 84/411 R, 84/421, 419, 420
See application file for complete search history.

(56) References Cited

U.S. PATENT DOCUMENTS 2,074,194 A * 3/1937 Strupe ..... 84/419
4,674,390 A * 6/1987 Allen et al. ..... 84/419
4,856,406 A * 8/1989 Ohmuro ..... 84/419

* cited by examiner

*Primary Examiner*—Kimberly Lockett
(74) *Attorney, Agent, or Firm*—Alan Kamrath; Kamrath & Associates PA

(57) ABSTRACT

A timpani with a foldable leg assembly has a timpani frame with a bottom, two legs and a bracket assembly. The legs and the bracket assembly are pivotally attached separated from each other to the bottom of the timpani frame. When the timpani needs to be stored or transported, the legs and the bracket assembly can be fold to reduce the overall volume of the timpani and easily transport or store timpani.

4 Claims, 5 Drawing Sheets

TIMPANI WITH A FOLDABLE LEG ASSEMBLY

BACKGROUND OF THE INVENTION

1. Field of the Invention

The present invention relates to a timpani, and more particularly to a timpani with a foldable leg assembly.

2. Description of Related Art

A timpani is a well known musical instrument. The timpani has a base frame and a kettle. The base frame has a top, a bottom, a driving device, two legs and a pedal. The two legs and the pedal are mounted separately from each other on the base frame. Each leg has a distal end and a wheel. The wheel is rotatably mounted on the distal end of the leg. The driving device is at the bottom of the base frame and connects to the pedal. The pedal is connected pivotally at the bottom of the base frame.

The kettle is mounted on the top of the base frame and has a top and a head. The head is mounted on the top of the kettle and has an adjustable tension. The tension of the head is controlled by pressing the pedal down so the driving device pulls the head down and increases the tension on the head. When the pedal is released, the head is loose.

This type of timpani has a major drawback that causes the timpani to be difficult transport and store. The pedal and the two legs are not foldable so the timpani always occupies a large space.

To overcome the shortcoming, the present invention provides a timpani with a foldable leg assembly to obviate or mitigate the aforementioned problems.

SUMMARY OF THE INVENTION

The primary objective of the present invention is to provide a foldable leg assembly to reduce the overall volume of a timpani so the timpani is easily stored and transported.

A timpani with a foldable leg assembly in accordance with the present invention has a timpani frame with a bottom, two legs and a bracket assembly. The legs and the bracket assembly are pivotally attached separately from each other to the bottom of the timpani frame. When the timpani needs to be stored or transported, the legs and the bracket assembly can be folded to reduce the overall volume of the timpani and easily transport or store the timpani.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
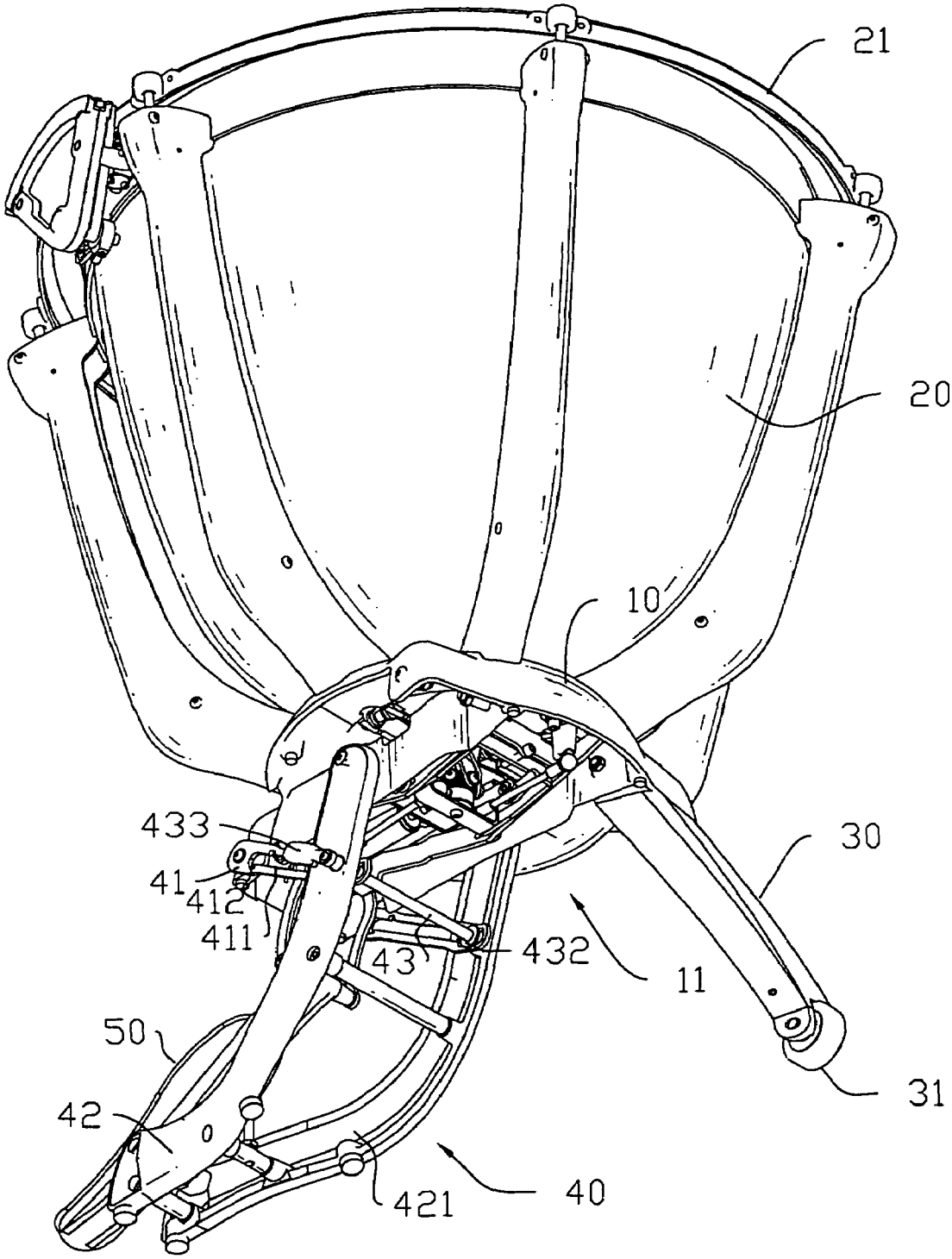
FIG. 1 is a perspective view of a timpani with a foldable leg assembly in accordance with the present invention.

With reference to FIG. 1, a timpani with a foldable leg assembly in accordance with the present invention has a timpani frame (10), a kettle (20), two legs (30), a bracket assembly (40) and a pedal (50).

Figure 2:
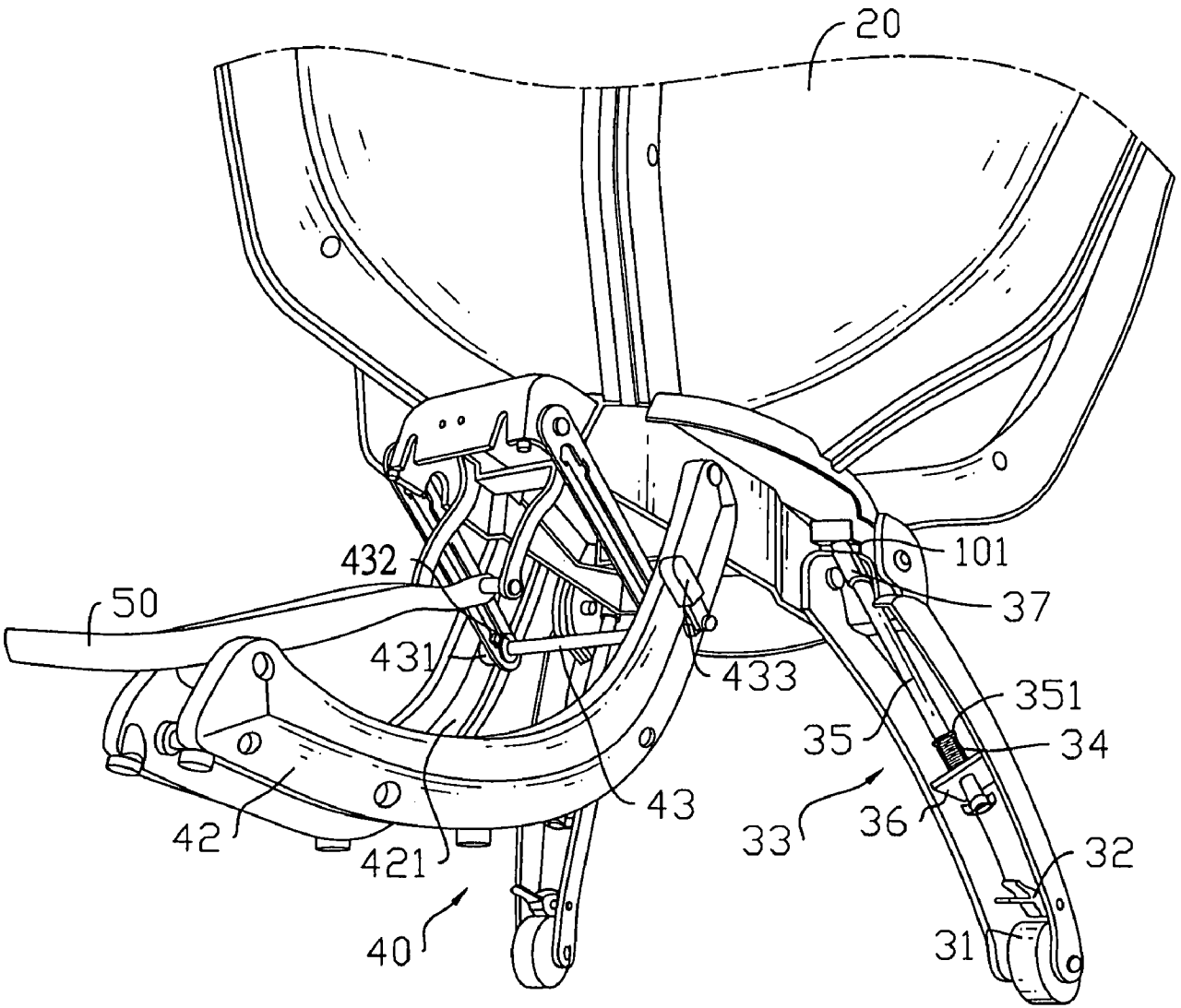
FIG. 2 is an enlarged perspective view of the foldable leg assembly in FIG. 1.

The timpani frame (10) has a top, a bottom and a driving assembly (11). The driving assembly (11) is mounted on the bottom of the timpani frame (10). With further reference to FIG. 2, the kettle (20) is mounted on the top of the timpani frame (10) and has a top, a head, a counterhoop (21) and two engaging notches (101). The head is mounted on the top of the kettle (20). The counterhoop (21) is mounted around the head and connects to the driving assembly (11) of the timpani frame (10) and applies tension to the head when the driving assembly (11) is activated. The two engaging notches (101) are formed at the bottom of the timpani frame (10). Since the application of tension to the head is conventional, further description is omitted.

The two legs (30) are connected pivotally to the bottom of the timpani frame (10), and each leg (30) has a distal end, a wheel (31), an optional brake (32), an inner side, an optional inner bracket (36), an optional seat (37) and a stopper assembly (33). The wheel (31) is attached rotatably to the distal end of the leg (30). The brake (32) is mounted pivotally at the distal end of the leg (30) and selectively presses against the wheel (31) to keep the wheel (31) from rotating. The inner bracket (36) is mounted on the inner side of the leg (30) and has a through hole. The through hole is formed through the inner bracket (36). The seat (37) is mounted on the inner side of the leg (30) and has a through hole. The through hole is formed through the seat (37).

The stopper assembly (33) has a push rod (35) and an optional spring (34). The push rod (35) is moveably mounted on the inner side of the leg (30) and has an optional annular slot, an optional clip (351), an engaging end and a pulling end. The annular slot is formed around the push rod (35). The engaging end of the push rod (35) extends through the through hole in the seat (37) and selectively engages with one of the engaging notches (101) in the timpani frame (10) so that the legs (30) are held in an expanded position with the engagements between the engaging notches (101) with the engaging ends of the pushing rod (35). When the pulling ends of the push rods (35) are pulled toward the wheels (31), the engaging ends of the pushing rods (35) disengage from the engaging notches (101) of the timpani frame (10) so that the legs (30) can be folded against the bottom of the timpani frame (10). The clip (351) is mounted in the annular slot of the push rod (35). The spring (34) is mounted around the push rod (35) between the clip (351) and the inner bracket (36).

Figure 3:
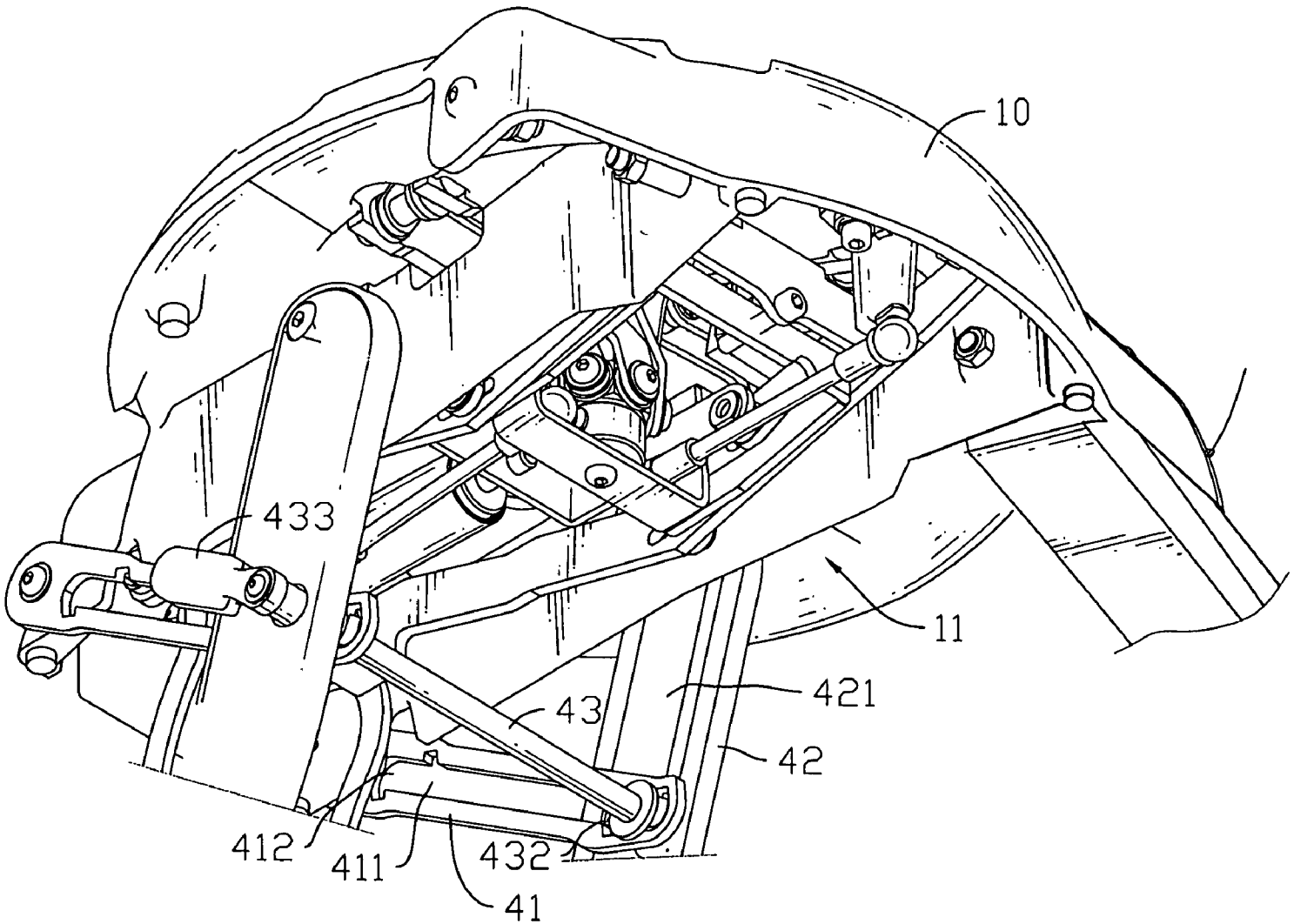
FIG. 3 is an enlarged partial perspective view of the foldable leg assembly in FIG. 2.

With further reference to FIG. 3, the bracket assembly (40) has a sliding bracket (41), a base bracket (42) and an adjustable rod (43). The sliding bracket (41) is attached pivotally to the bottom of the timpani frame (10) opposite from the two legs (30) and has two sides and two tracks (411). The two tracks (411) are formed respectively through the two sides of the sliding bracket (41), and each track (41) has two ends and two engaging notches (412). The two engaging notches (412) are formed respectively at the two ends of each track (41).

The base bracket (42) is attached pivotally to the bottom of the timpani frame (10) opposite to the two legs (30) and has two sides, two inner sides, two adjustable rod holes, and two sliding slots (421). The two adjustable rod holes are formed respectively through the two sides of the base bracket (42) and correspond to each other. The sliding slots (421) are formed respectively in inner sides of the base bracket (42).

Figure 5:
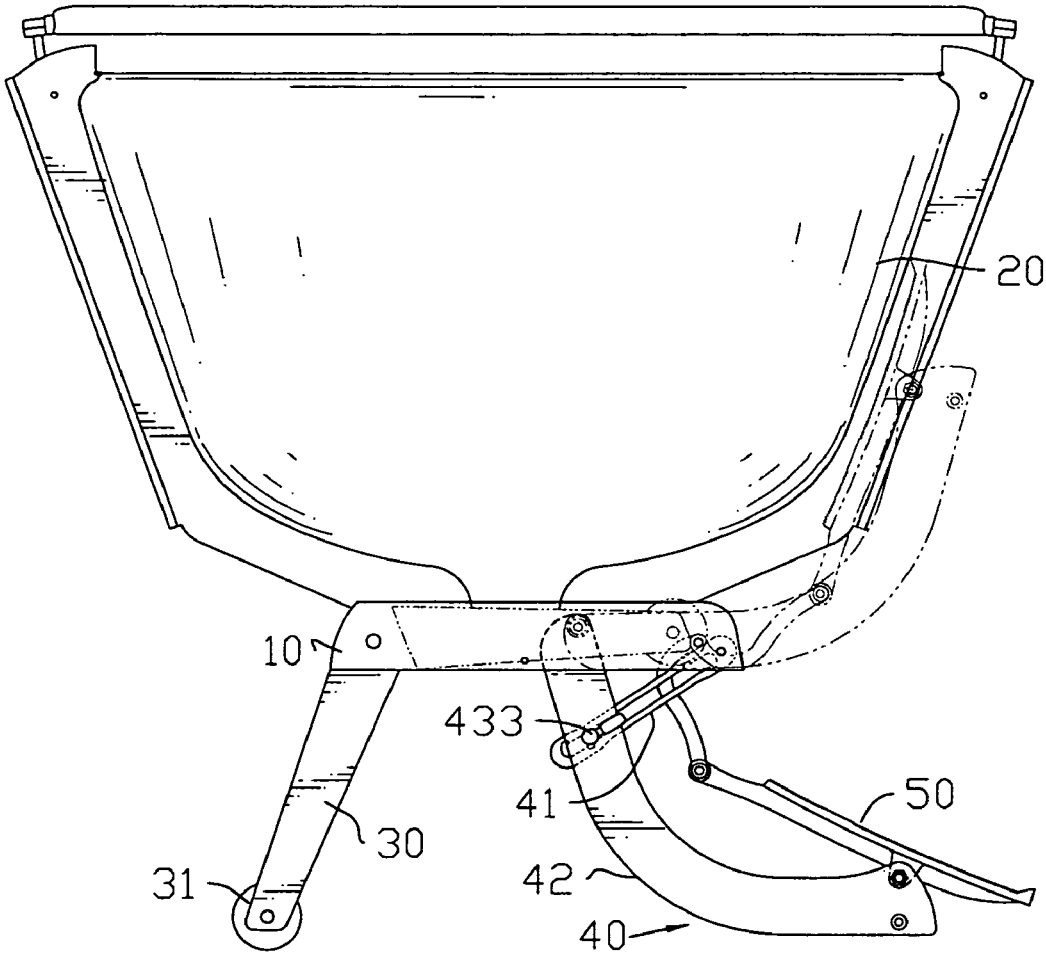
FIG. 5 is an operation side view of a timpani with the foldable leg assembly in FIG. 2 with a base bracket folded.

The adjustable rod (43) extends through the two adjustable rod holes in the base frame (42) and the two tracks (411) in the sliding bracket (41) and has two ends, two trackers (431), two latches (432) and a lever (433). One tracker (431)

and one latch (432) are mounted on each end of the adjustable rod (43). The trackers (431) moveably engage the sliding slots (421) in the base bracket (42). The latches (432) are slidably mounted respectively in the tracks (411) in the sliding bracket (41) and selectively engage notches (412) in tracks (411) in the sliding bracket (41) to hold the bracket assembly against the kettle (20) in a folded position or in an extended position so the timpani can stand on the bracket assembly (40) and the legs (30). With further reference to FIG. 5, the lever (433) is attached to one end of the adjusting rod (43) and rotates the adjusting rod (43) and the latches (432) into and out of engaging notches (412) at ends of the tracks (411) in the sliding brackets (41).

Figure 4:
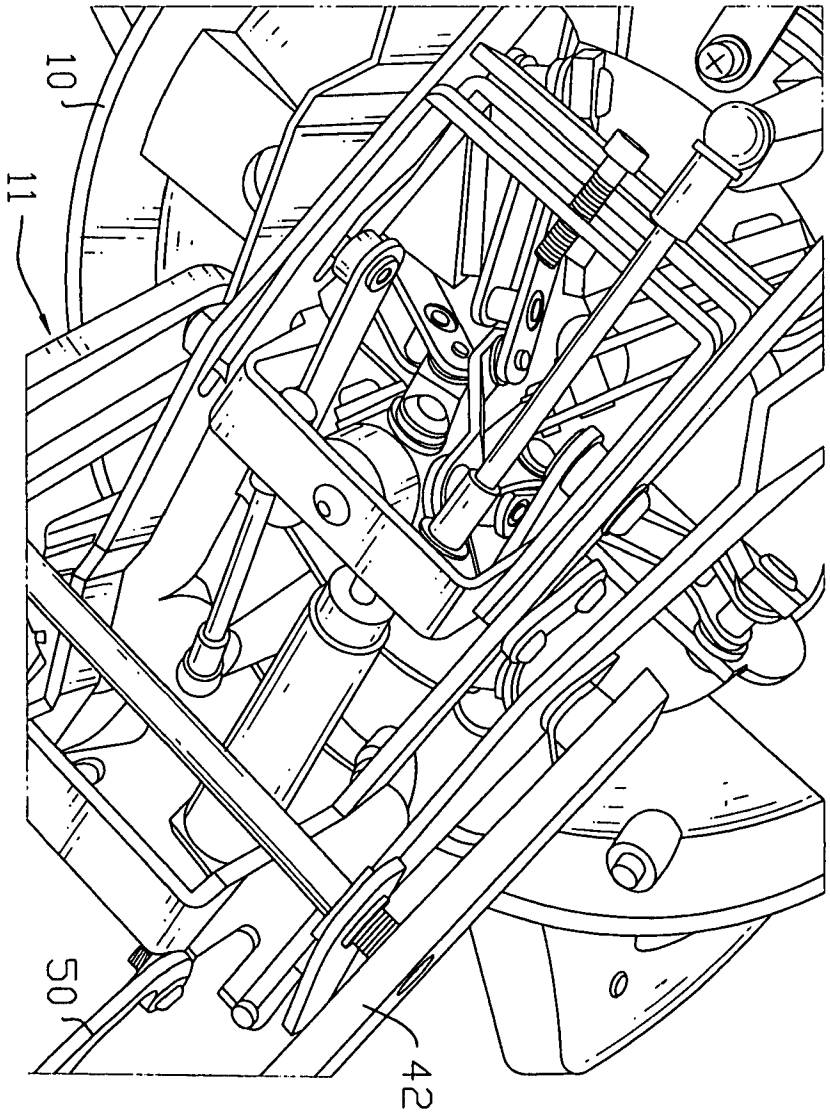
FIG. 4 is an partial bottom perspective view of the foldable leg assembly in FIG. 3.

With further reference to FIG. 4, the pedal (50) is pivotally connected to the driving assembly (11) and mounted pivotally to the base bracket (42).

With the reference to FIG. 5, when the switch (433) of the adjustable rod (43) is turned, the stoppers (432) of the adjustable rod (43) is leaving the engaging slots (412) of the sliding bracket (41) and moving in the tracks (411) of the sliding bracket (41) until the stoppers (432) reach to another engaging slots (412) of the sliding bracket (41).

The base bracket (42) and the sliding bracket (41) are foldable. The sliding bracket (41) is pivotally moving toward to the bottom of the timpani frame (10). The base bracket (42) with the pedal (50) is moving toward to the kettle (20). The pedal (50) is pivotally moving toward to the base bracket (42).

When the base bracket (42) is folded to the kettle (20), the pedal (50) is located between the kettle (20) and the base bracket (42). The switch is turned again so that the stoppers (432) engage to the engaging slots (412) of the sliding bracket (41).

Since the bracket assembly (40) and the legs (30) are foldable, the volume of the timpani can be reduced to make storing and transporting the timpani easier and more convenient.

Even though numerous characteristics and advantages of the present invention have been set forth in the foregoing description together with details of the structure and function of the invention, the disclosure is illustrative only. Changes may be made in detail especially in matters of shape, size, and arrangement of parts within the principles of the invention to the full extent indicated by the broad general meaning of the terms in which the appended claims are expressed.

What is claimed is:

1. A timpani comprising a timpani frame having a top, a bottom and two engaging slots formed at the bottom of the timpani frame;

a driving device located at the bottom of the timpani frame; and a foldable leg assembly mounted on the timpani frame and comprising:

two legs connected pivotally to the bottom of the timpani frame, and each leg having a distal end;

a wheel rotatably attached rotatably to the distal end of the leg;

an inner side; and a stopper assembly having a push rod moveably mounted on the inner side each of the legs and having an engaging end selectively engages with one of the engaging slots in the timpani frame; and a pulling end;

a bracket assembly having a sliding bracket attached pivotally to the bottom of the timpani frame opposite to the two legs and having two sides; and two tracks formed respectively through the two sides of the sliding bracket, and each track having two ends; and two engaging notches formed respectively at the two ends of the track;

a base bracket attached pivotally to the bottom of the timpani frame opposite to the two legs and having two sides;

two inner sides;

two adjustable rod holes formed respectively through the two sides of the base bracket and corresponding to each other; and two sliding slots formed respectively in the inner sides of the base bracket; and an adjustable rod extending through the two adjustable rod holes in the base bracket and the two tracks in the sliding bracket and having two ends;

two trackers mounted respectively on the ends of the adjustable rod and moveable engaging the sliding slots in the base bracket;

two latches mounted respectively on the ends of the adjustable rod, sliding in the tracks in the sliding bracket and selectively engaging the engaging notches in the tracks in the sliding bracket; and a lever attached to one end of the adjusting rod and rotating the adjusting rod and the latches; and a pedal pivotally connected to the driving device of the timpani frame and mount pivotally to the base bracket.

2. The timpani with a foldable leg assembly as claimed in claim 1, wherein each leg has a brake mounted pivotally at the distal end of the leg and selectively pressing against the wheel.

3. The timpani with a foldable leg assembly as claimed in claim 2, wherein each leg further has an inner bracket mounted on the inner side of the leg and having a through hole formed through the inner bracket; and a seat mounted on the inner side of the leg and having a through hole formed through the seat; and each of the engaging ends of the push rods extends through the though hole in the inner bracket and the through hole in the seat.

4. The timpani with a foldable leg assembly as claimed in claim 3, wherein the push rod further has a clip mounted each of the push rods; and the stopper assembly further has a spring mounted around the push rod between the clip and the inner bracket.

* * * * *